US006506172B1

(12) United States Patent
Hepburn et al.

(10) Patent No.: US 6,506,172 B1
(45) Date of Patent: Jan. 14, 2003

(54) SUPINATOR/PRONATOR THERAPY SYSTEM TO BRING MOBILITY TO WRIST, FOREARM AND/OR ELBOW

(75) Inventors: George R. Hepburn, Severna Park, MD (US); Russell Vedeloff, Greensboro, MD (US)

(73) Assignee: Dynasplint Systems, Inc., Severna Park, MD (US)

( * ) Notice: Subject to any disclaimer, the term of this patent is extended or adjusted under 35 U.S.C. 154(b) by 0 days.

(21) Appl. No.: 09/685,470

(22) Filed: Oct. 10, 2000

(51) Int. Cl.[7] ..... A61H 1/02
(52) U.S. Cl. ..... 601/5; 601/33
(58) Field of Search ..... 601/5, 33, 40; 128/878, 879, 881; 602/21, 20; 482/45

(56) References Cited

U.S. PATENT DOCUMENTS 2,819,081 A * 1/1958 Touraine ..... 601/5
2,832,334 A * 4/1958 Whitelaw ..... 601/5
5,337,737 A 8/1994 Rubin et al. ..... 601/33
5,365,947 A 11/1994 Bonutti ..... 128/898
5,520,625 A * 5/1996 Malewicz ..... 602/21
5,662,595 A 9/1997 Chesher et al. ..... 601/33
5,738,636 A * 4/1998 Saringer et al. ..... 601/5
5,848,979 A * 12/1998 Bonutti et al. ..... 601/5
5,951,499 A * 9/1999 Saringer et al. ..... 601/33
6,179,799 B1 * 1/2001 Doran ..... 602/20

* cited by examiner

*Primary Examiner*—Danton D. DeMille
(74) *Attorney, Agent, or Firm*—Armstrong, Westerman & Hattori, LLP

(57) ABSTRACT

A passive therapy device useful for bringing back mobility to the wrist, forearm and/or elbow after immobilization. The device provides therapy to restricted tissue in the wrist, forearm and/or elbow while applying passive tension during therapy. The therapy device is able to readily convert from supination therapy to pronation therapy. In addition, the device can be converted for either right hand use or left hand use.

14 Claims, 18 Drawing Sheets

SUPINATOR/PRONATOR THERAPY SYSTEM TO BRING MOBILITY TO WRIST, FOREARM AND/OR ELBOW

FIELD OF THE INVENTION

The invention finds applicability in the field of limb rehabilitation after injury.

BACKGROUND OF THE INVENTION

Where there is injury to the wrist or forearm, in many cases the forearm and wrist must be immobilized. After immobilization, the wrist, forearm and elbow are stiff. In view of this fact, it would be desirable to bring flexibility back to the stiff joints as quickly as possible. The device of this invention accomplishes this objective.

OBJECTS OF THE INVENTION

The main object of this invention is to produce a therapy device which will allow for rapid rehabilitation of a stiff wrist, elbow or forearm.

Another object of this invention is to produce a device with a tension mechanism which is adjustable to produce greater or lesser tension-pressure or force on the joint as required.

A further object of this invention is to produce a therapy device which will produce by passive orthrosis stretching of restricted tissue in the wrist, forearm or elbow.

Other objects of the present invention will become apparent from a reading of the following specification taken in conjunction with the enclosed drawings.

BRIEF SUMMARY OF THE INVENTION

The Dynasplint™ Supinator/Pronator Therapy System is a device designed to treat limited range-of-motion in the elbow, wrist and forearm caused by shortened connective tissues. This condition is most often the result of the elbow or wrist necessarily being immobilized for several days or weeks following an injury, illness or surgery. Elbow, forearm and wrist fractures, dislocation, burns and surgical repairs of torn ligaments are the primary conditions requiring immobilization at the elbow or wrist; thus, the ability to fully supinate or pronate the forearm can then be lost.

The supinator/pronator therapy device of this invention is unique in being able to adjust for the degree of rotation of the forearm during treatment and to be able to adjust the amount of tension which can be applied. The device is a passive therapy device; that is, the device stretches restricted tissue, without dynamic action on the part of the patient.

A key feature of the Supinator/Pronator Therapy System is the putting of pressure on, for example, a frozen wrist joint or frozen elbow joint caused by shortened connective tissues. The Supinator/Pronator Therapy System is designed to apply low-force on shortened connective tissue for prolonged periods of time during each 24-hour day. By the use of this system, permanent connective tissue elongation will be brought about.

For purposes of this invention:

The term "Supinate" means to rotate or place the hand or forelimb so that the palmar surface is upward when the limb is stretched forward horizontally.

The term "Pronate" means to rotate or place (the hand or forelimb) so that the palmar surface downward when the limb is stretched forward horizontally.

PRIOR ART PATENTS

Chesher et al U.S. Pat. No. (5,662,595) show an orthopedic exercise device to assist in regaining pronation and supination motion for a joint. In this device force opposing rotation of the forearm about the elbow joint is adjustable.

Bonutti U.S. Pat. No. (5,365,947) teaches an adjustable orthosis for stretching tissue by moving a joint between a first and second position. Various degrees of force can be applied during the stretching operation.

Rubin et al U.S. Pat. No. (5,337,737) teach a device for incorporating resistance to a joint such as the elbow in order to dampen rapid dysmetric action.

None of the prior art patents cited show a low-force system applied over a long period of time; and with the force or tension being able to be adjusted as required.

DESCRIPTION

Figure 1:
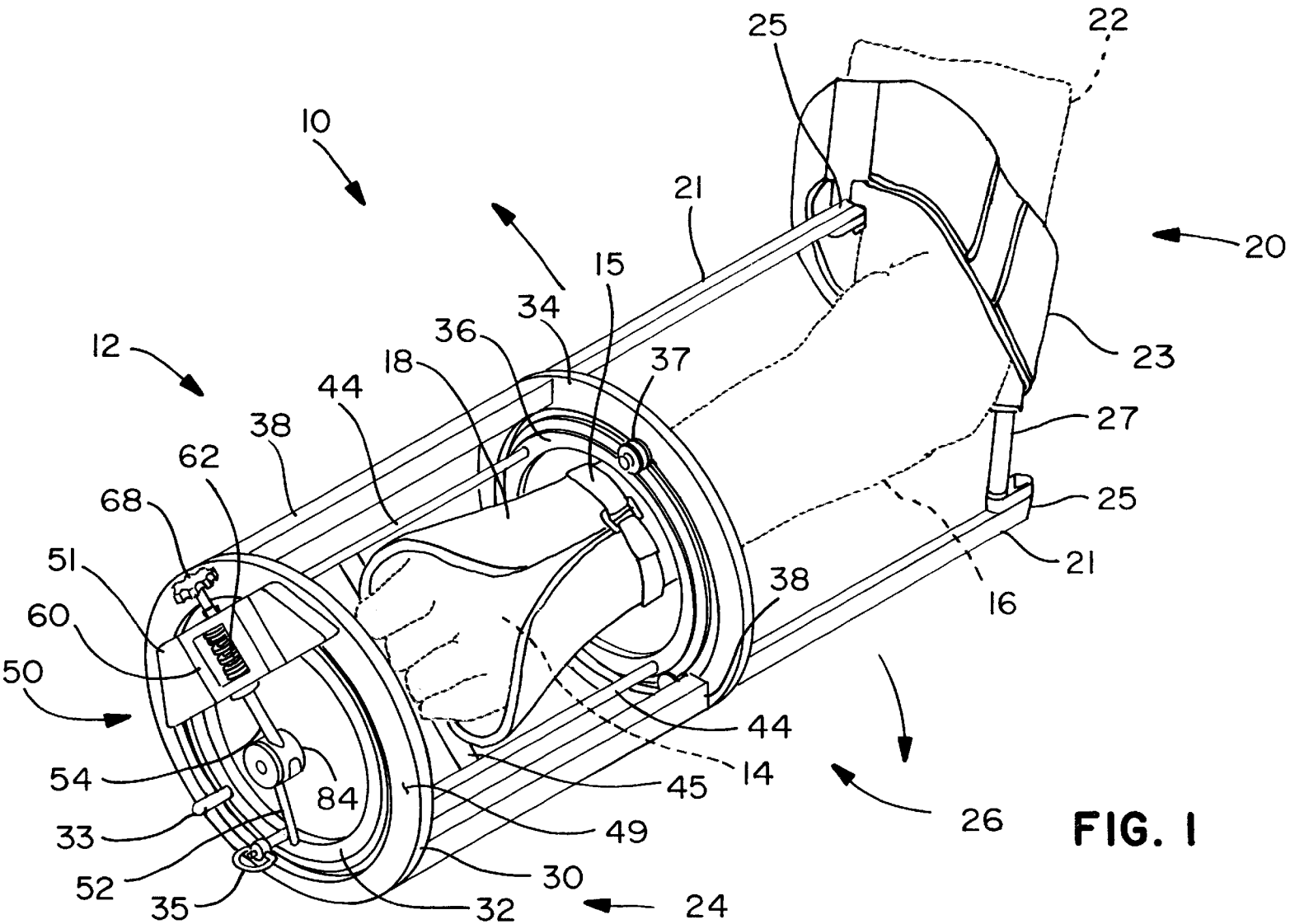
FIG. 1 is a perspective view of the supinator/pronator therapy device of this invention.
Figure 5:
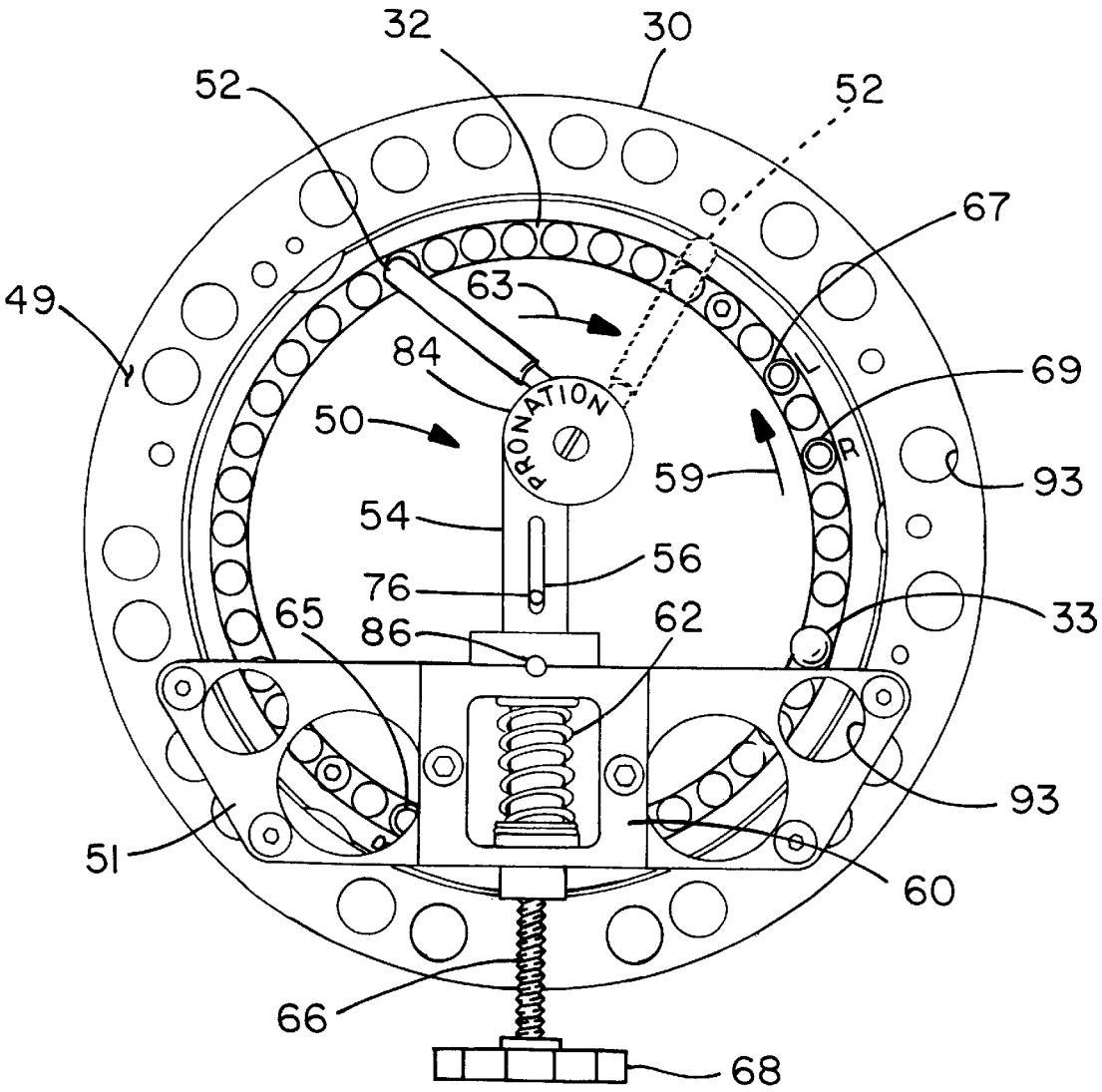
FIG. 5 is a front end view thereof in the rest position.
Figure 6:
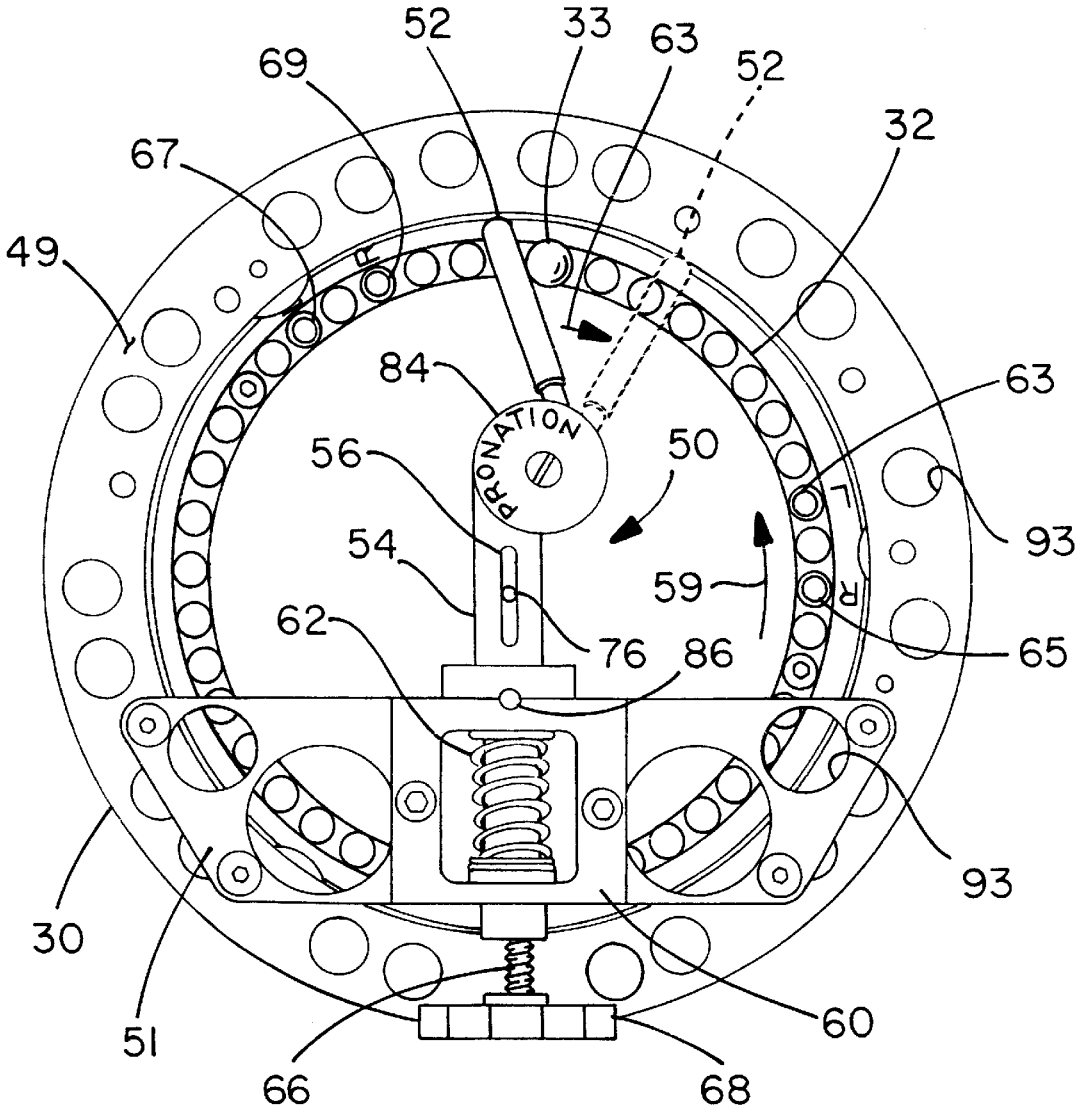
FIG. 6 is a front end view thereof in a rotated position with the fixed pin abutting the stem rod.
Figure 7:
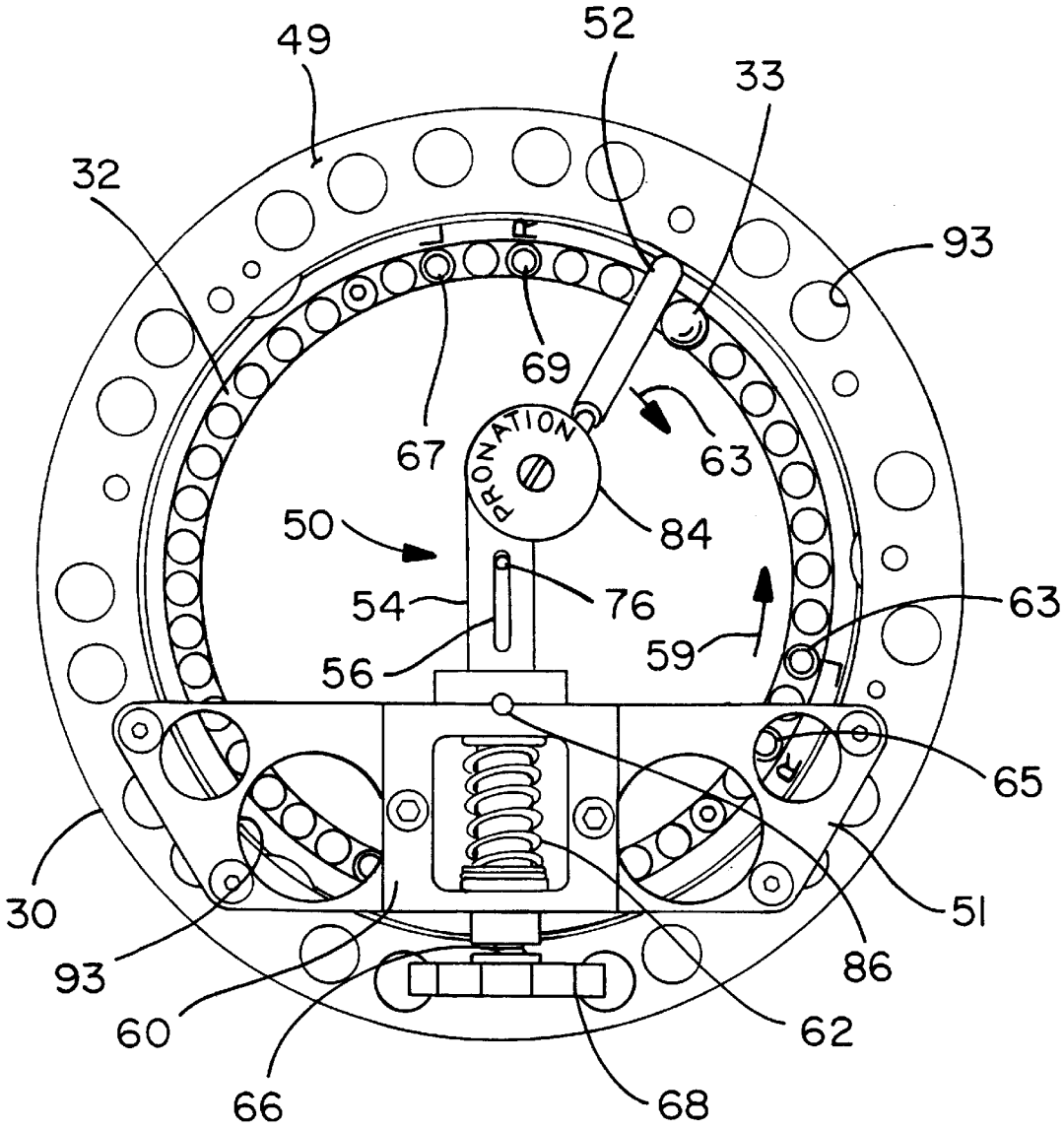
FIG. 7 is a front end elevational view thereof, with the stem rod applying maximum pressure.
Figure 8:
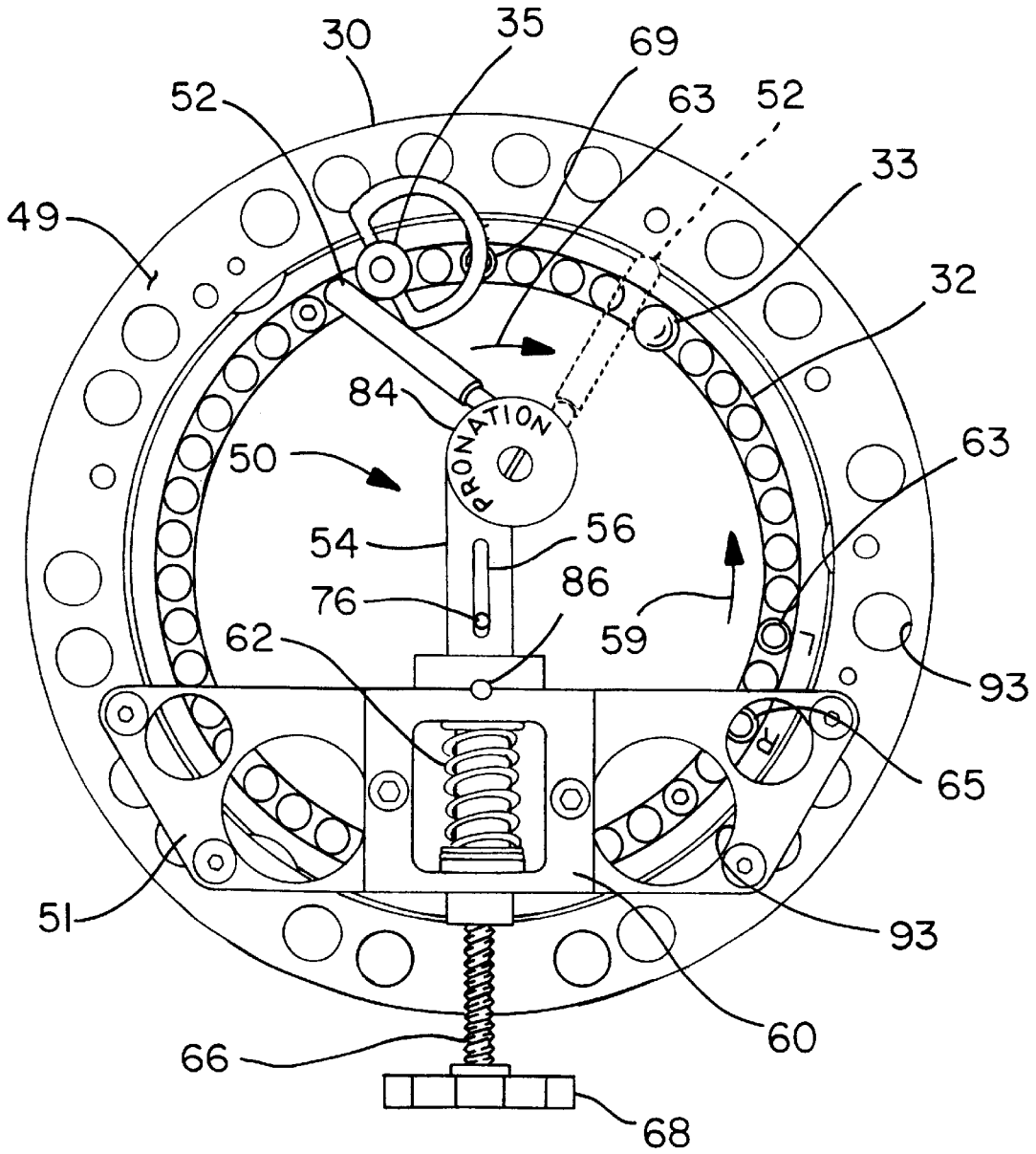
FIG. 8 is a front end thereof with the the stem rod applying pressure to the movable pin.

With reference to FIG. 1 supinator/pronator therapy device 10 of this invention has a distal portion 12 for retaining the hand 14 and the forearm 16; and a proximal portion 20 (end closest to the user) for retaining the upper arm (partially shown). The distal portion 12 (away from user) of the physical therapy device 10 has a front end 24 and a rear end 26. The front end 24 has a circular unit of a larger outer ring 30 and a smaller inner ring 32 (as best shown in FIGS. 5, 6 and 7). As best shown in FIGS. 7 and 8, the circular unit of the rear end is composed of a larger outer ring 34 and a smaller inner ring 36. The circular unit of the front end is joined to the circular unit of the rear end through strut sleeves 38.

Figure 2:
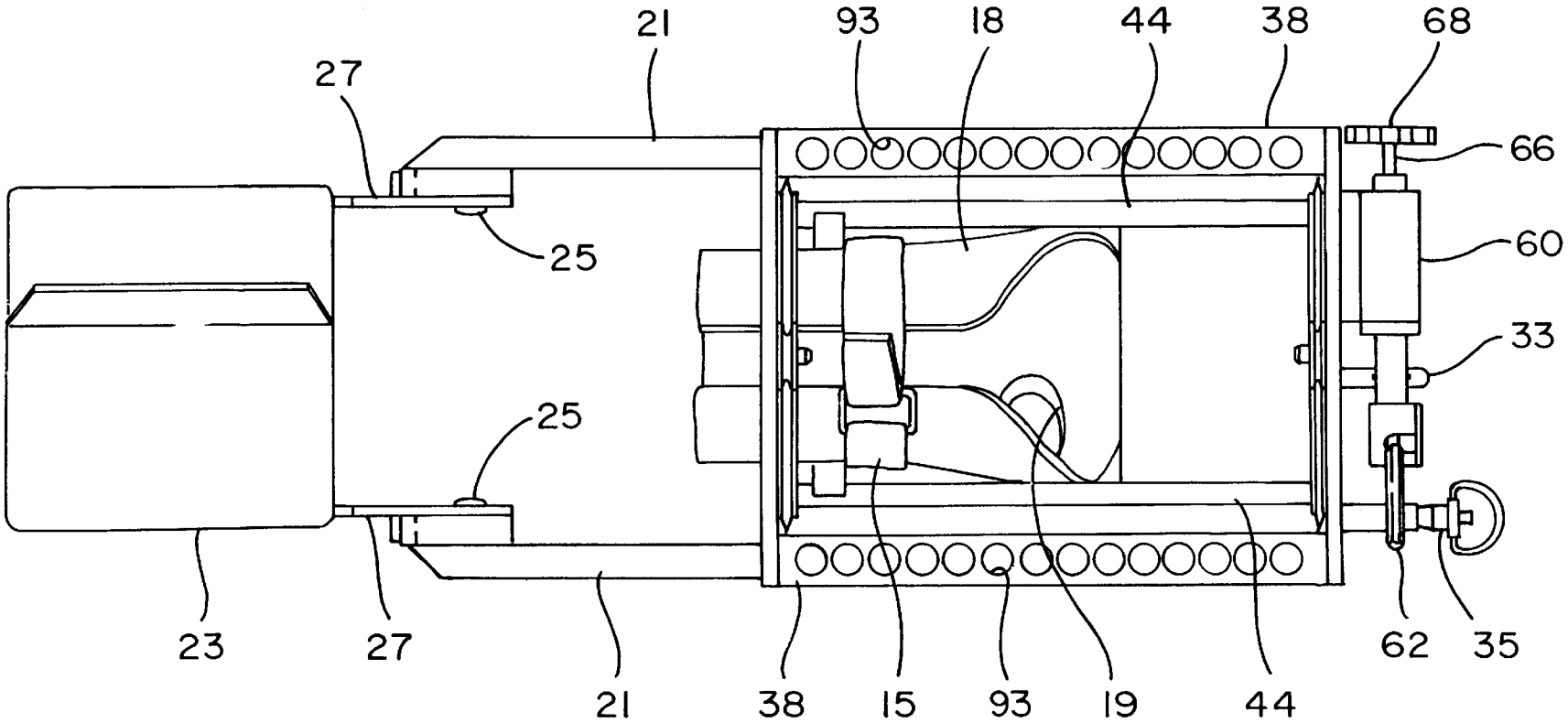
FIG. 2 is a top plan view thereof.
Figure 3:
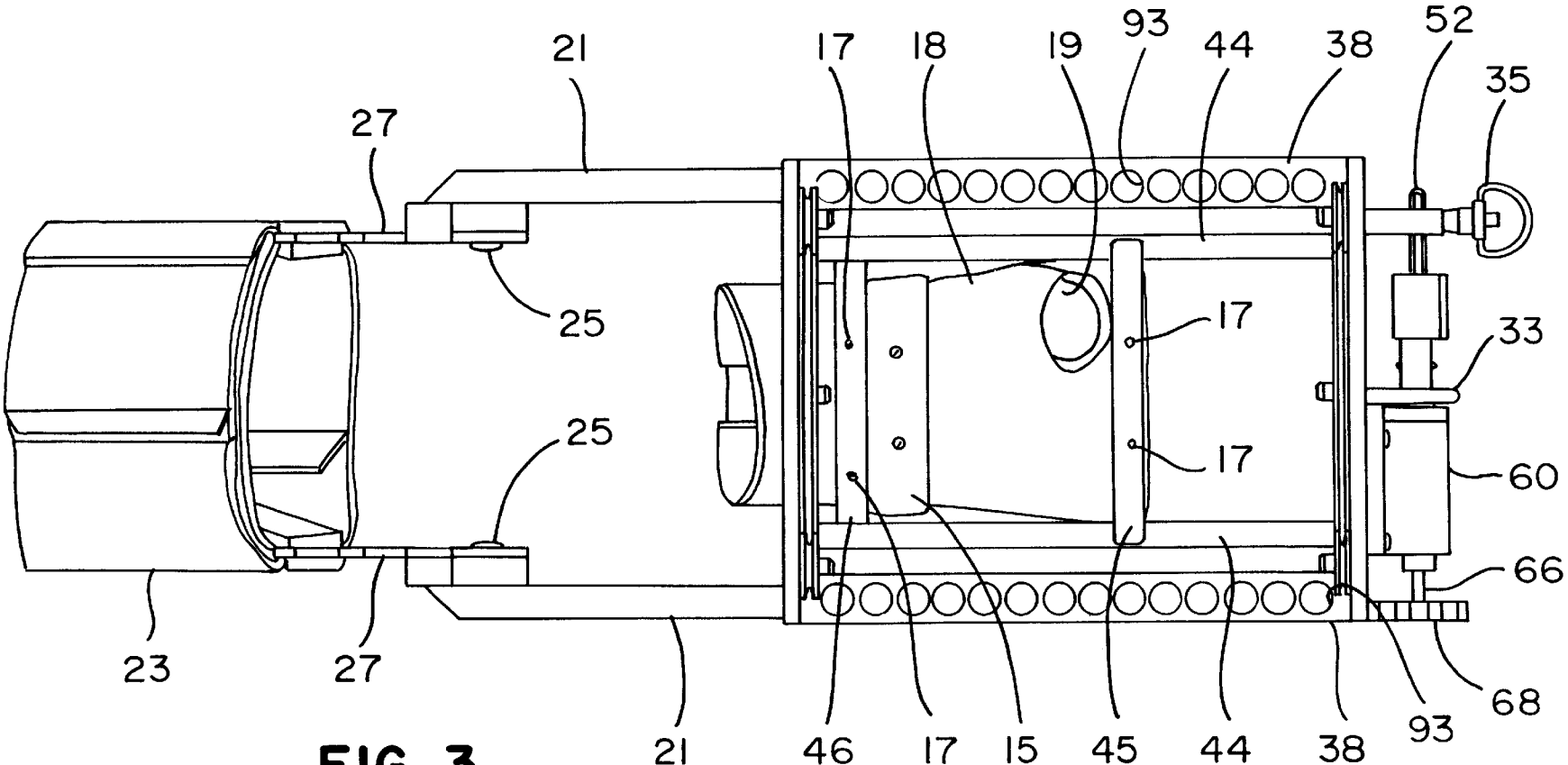
FIG. 3 is a bottom plan view thereof.
Figure 4:
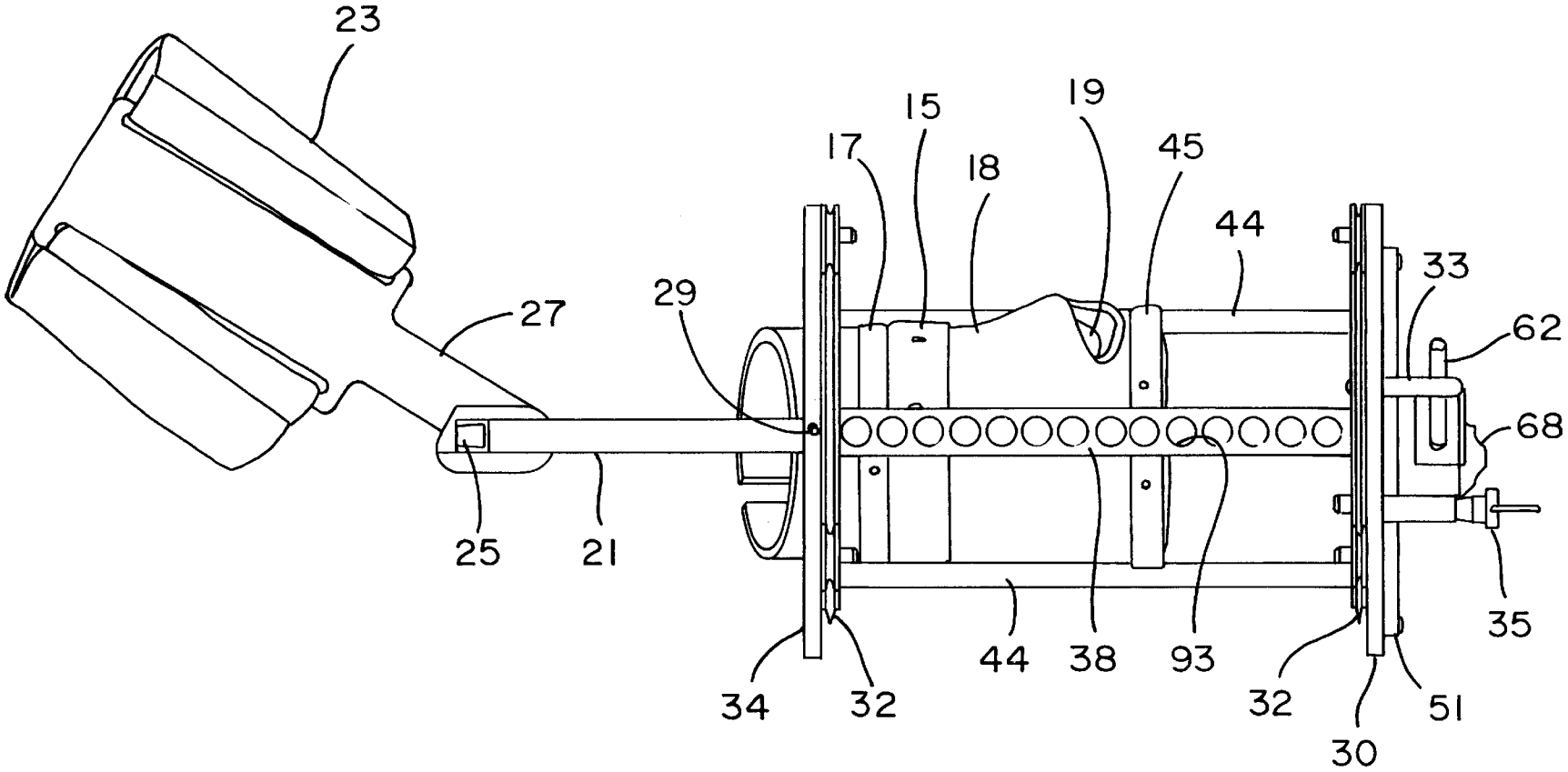
FIG. 4 is a side plan view thereof.

As shown in FIGS. 1–4 the hand 14 is placed in wrist stabilizer 18 and secured by wrist stabilizer strap 15. The wrist stabilizer strap has a velcro securing means, but other fasteners would be operative. As best shown in FIGS. 2–4, wrist stabilizer 18 is provided with a thumb hole 19 for comfortable accommodation of the hand in the wrist stabilizer. The distal portion 12 retains the hand 14 and forearm 16. The upper arm 22 is retained by an upper arm cuff 23. The proximal portion 20 of physical therapy device 10 is hinged to the distal portion 12 through hinges 25 attached to telescoping struts 21 and upper arm struts 27. Hinges 25 allow for flexing the elbow. As shown in FIG. 1, the left hand and forearm are positioned in the therapy device. The device 10 as shown in the figures is designed to accommodate the left hand. The wrist stabilizers for the hand are exchangeable to accommodate either the right or left hand. As best shown in FIG. 3, the left hand wrist stabilizer could be replaced by a right hand wrist stabilizer through screws 17 attached to cradles 45 and 46.

It is essential that when inserting the upper arm in the therapy device that the upper arm cuff be as snug as possible around the upper arm. This will insure that maximum rotational stretch will be received by the wrist, elbow or forearm, as the need may be.

For purposes of comfort, the wrist stabilizers for the hand may include felt pads as the user finds necessary for comfort.

The therapy device 10 has a telescoping strut arrangement to accommodate various forearm lengths. Telescoping struts 21 telescope into strut sleeves 38 and set screws 29 (FIG. 4) at rear outer ring secure telescoping struts 21 in strut sleeves 38.

Figures 12, 13:
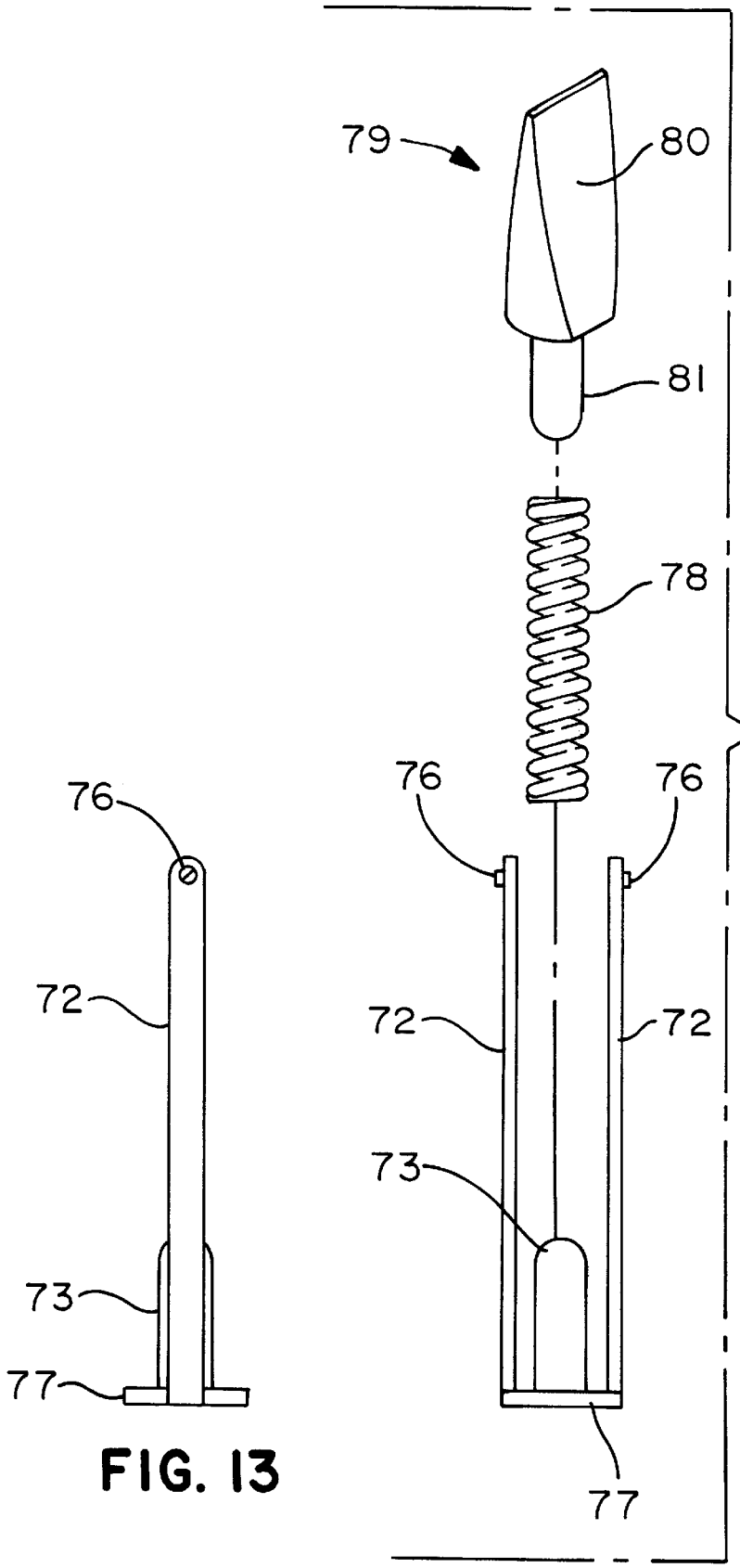
FIG. 12 is an exploded view illustrating the tensioning components inside the housing tube assembly.
FIG. 13 is a side view of the indicator bar assembly.
Figure 19:
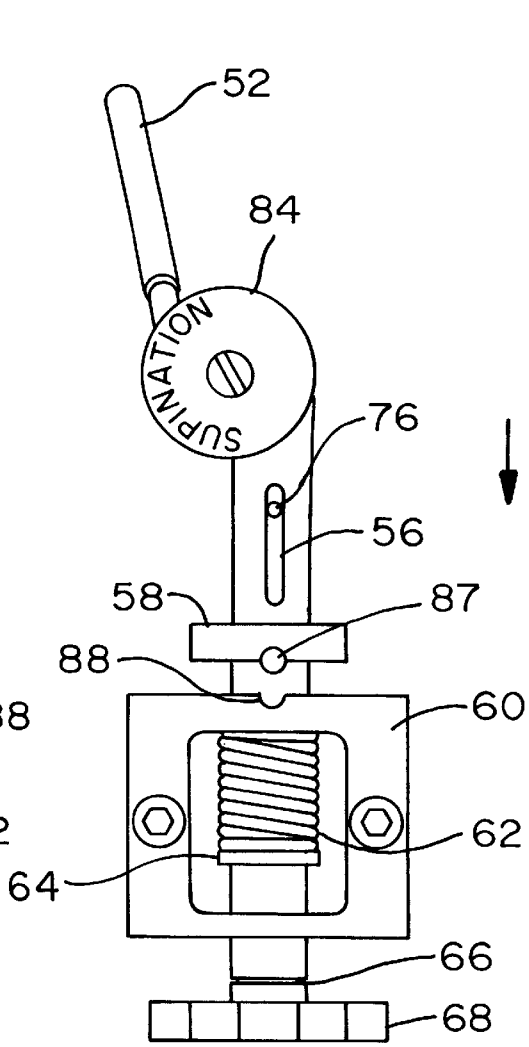
Figure 18:
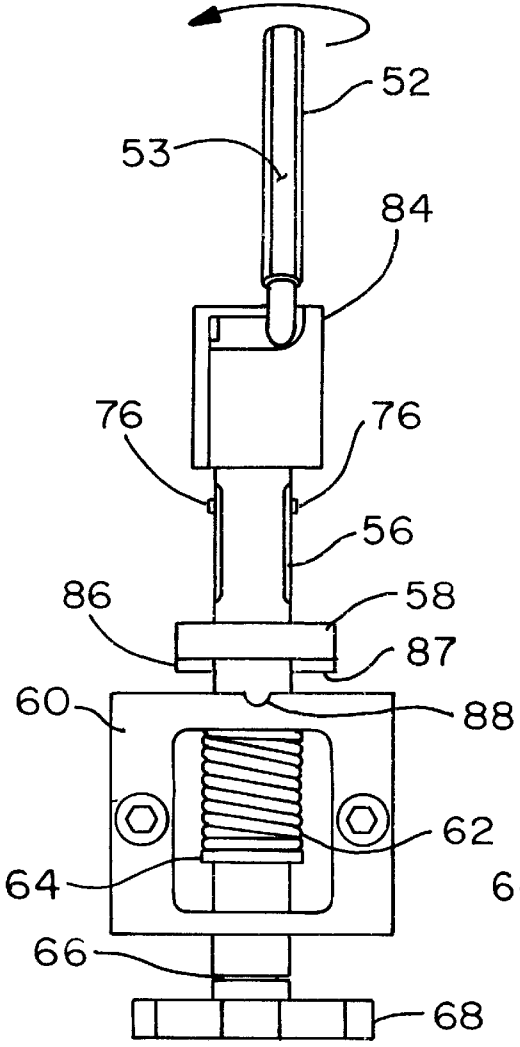
Figure 17:
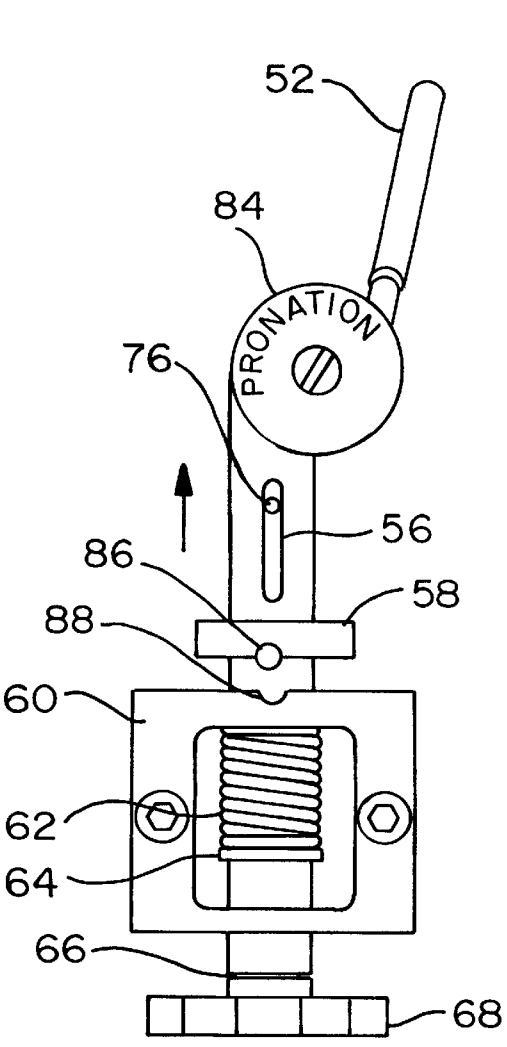

With reference to FIGS. 1, 5–8, 12, 13 and 16–20, a key element to the supinator/pronator therapy device is a housing tube assembly 50 housed in a housing tube 54. As part of the tension mechanism there is a housing tube bracket base 60, a locking spring 62 (FIG. 5), a spring spacer 73 and an indicator bar 72 (FIGS. 12 and 13). The tensioning unit is mounted on housing tube bracket 51 which in turn is mounted on the outer surface 49 of the front end outer ring 30. With reference to FIGS. 5–8 and 16–20, tensioning unit 50 has external components made up of a stem rod 52, housing tube 54 indicator bar viewing slot 56, dowel pins 86 and 87 are affixed to locking collar 58, housing tube bracket base 60, locking spring 62, loading screw 66, loading screw knob 68. There is a housing tube bracket base 51 (FIGS. 5–8) to which has attached a housing tube bracket cradle 60. The housing tube 54 is yieldably mounted on housing tube bracket base 60. Locking spring 62 surrounds housing tube 54. The locking spring 62 surrounding the housing tube 54 keeps housing tube 54 securely fixed to the housing tube bracket cradle 60. As best shown in FIGS. 17–19, the housing tube 54 can be swivelled and change position by 180°. This change allows the flat side 53 of stem rod 52 to be juxtaposed to the fixed pin 33 or the removable pin 35, to produce use in either the supination or pronation position. Note that when swiveling housing tube 54 from pronation position to supination position the fixed pin 33 on front inner ring 32 should be moved counter-clockwise to abut housing bracket 51 on the opposite side. The adjustment of load on the loading spring will be the same for both pronation or supination.

Figure 9:
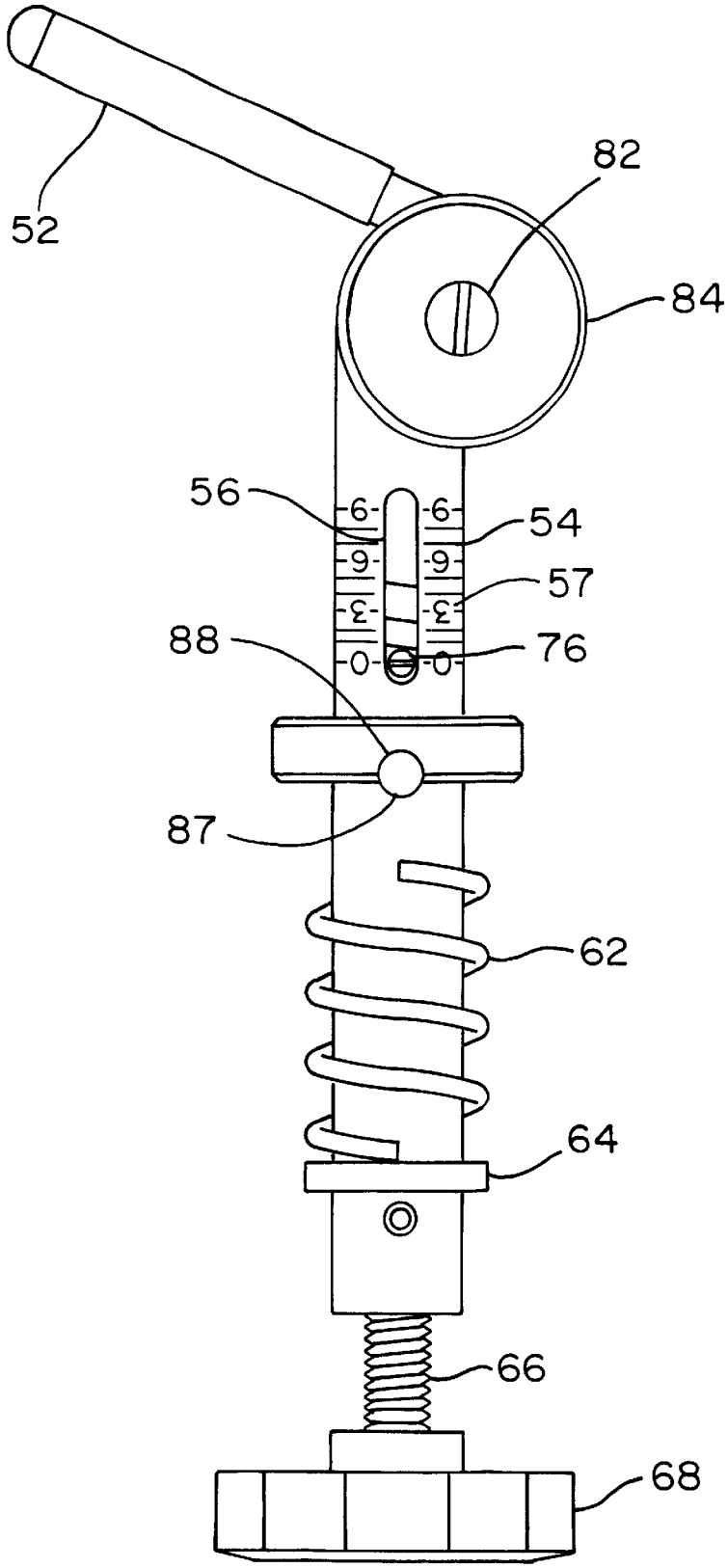
FIG. 9 is a view of the housing tube assembly removed from the bracket cradle.
Figure 10:
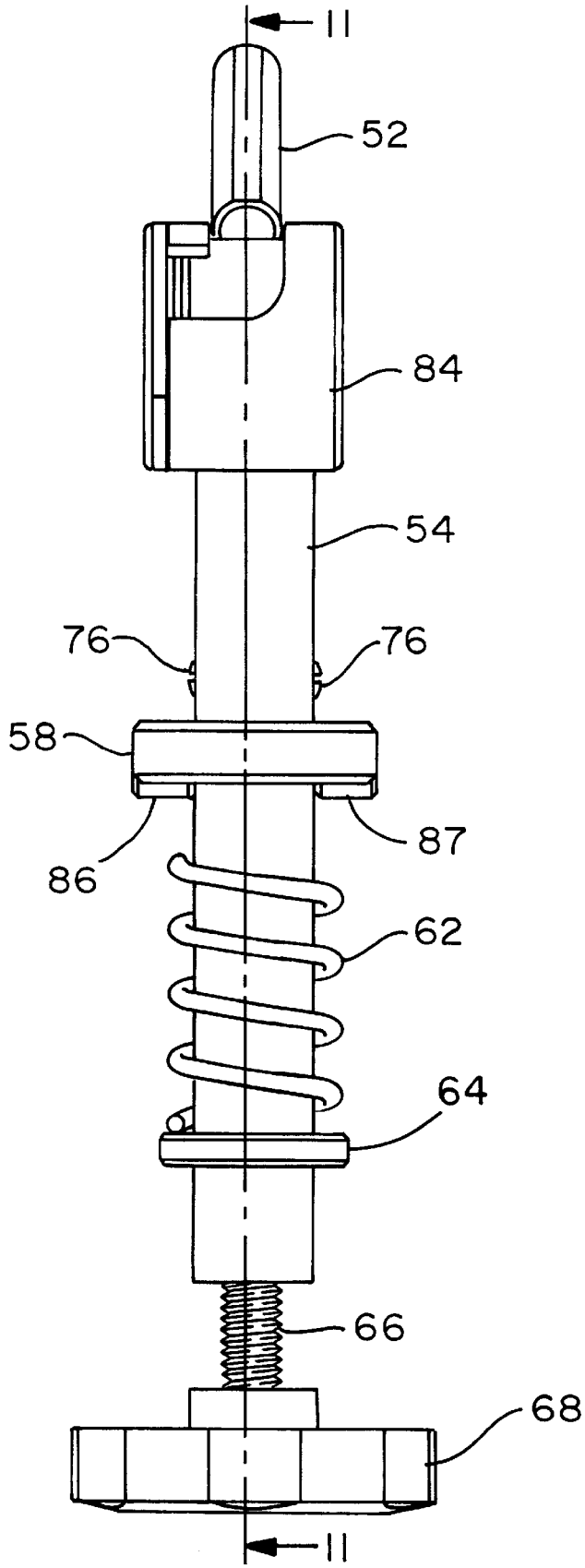
FIG. 10 is a view of the housing tube assembly of FIG. 9 turned 90°.
Figure 11:
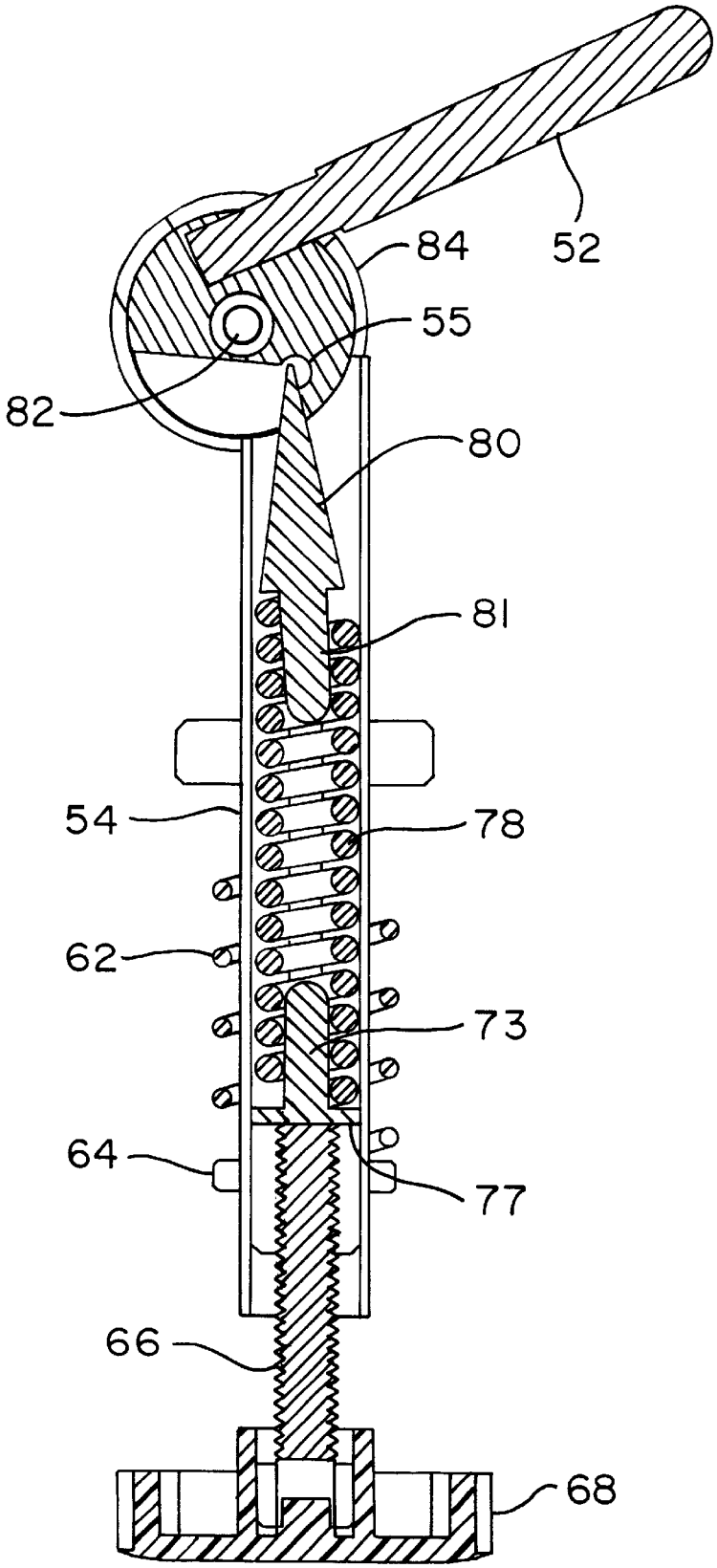
FIG. 11 is a cross-sectional view taken along lines 11—11 of FIG. 10.

With reference to FIGS. 5–8 the front end elevational view of the Supinator/Pronator Therapy Device is shown. FIG. 5 shows the device in a rest position with the stationary pin 33 against the housing bracket 51. Referring to FIG. 5 stem rod 52 is shown also in dashed lines, the arrow 63 shows the direction that the stem rod 52 moves as the loading knob 68 is turned and greater load is placed on loading spring 78 (FIG. 11). As the loading knob 68 is turned indicator screw 76 raises to a higher number as viewed at the viewing slot 56 (FIG. 9).

Note that in FIG. 5–8 the housing tube assembly 50 has the housing head 84 turned so that Pronation is indicated however on the reverse side of housing head 84 Supination will be indicated. As best shown in FIGS. 16–20 the two sides of the housing head are shown. Further, in FIG. 5 loading screw 66 is screwed out and the loading spring 78 (best shown in FIG. 11) is relaxed. As best shown in FIG. 9 the relaxed state of the loading spring 78 is indicated by indicator screw being at the low end of the scale 57 with the lower numbers indicating low load or pressure on loading spring 78.

Note that in FIG. 5 indicator screw 76 as viewed through viewing slot 56 is in the low position indicating minimum load on loading spring 78. The elevational view of FIG. 5 illustrates that Supinator/Pronator Therapy Device as it would be once the patient's wrist, forearm and elbow are initially placed in wrist stabilizer 18 and arm cuff 23.

With reference to FIG. 6 once the patient's wrist, forearm and elbow are secured in the wrist stabilizer 18 and upper arm cuff 23, the device is adjusted so that fixed pin 33 abuts the flat side 53 (best shown in FIG. 18) of stem rod 52. Note in FIG. 6 that stem rod 52 is shown in dashed lines as well as solid lines to show the potential range of travel of stem rod 52 as load is applied by turning loading knob 68. Arrow 59 indicates the direction that fixed pin 33 travels to reach stem rod 52. Once the fixed pin abuts the stem rod, the loading screw knob 68 is turned clockwise the number of revolutions required to have the stem rod 52 just begin to slightly push the fixed pin 33 to a position of rotation which just meets the end range position available to the patient. This positioning is based on where the patient's range of motion (ROM) restriction begins. For instance, if the patient's ROM is restricted to 60° supination (90° is desired), the beginning tension level will be approximate "2" on the scale 57 as indicated by indicator screw 76 (as best shown in FIG. 9). In therapy the loading screw is to be turned increasing the load on the loading spring 78. The increase in load on the loading spring is designed to stretch the restricted tissue of the wrist, forearm or elbow as the case may be. It is suggested that the patient wear the device several hours a day over several days and after several days of wearing, the loading screw knob should be turned again clockwise again causing stretching of the restricted tissue. Of course, as the loading screw knob is turned the indicator screw 76 is raised to a higher number. The device is to be used several days for several hours a day. Of course, as previously pointed out, each increase in load will cause a corresponding stretching of restricted tissue.

Note that in FIGS. 5, 6 and 7 the loading screw 66 is shown being progressively shortened and indicator screw 76 is shown raised from a low number to a higher number. All of this indicating greater load on the loading spring 78 and accordingly greater stretch to restricted tissue in the wrist, forearm and elbow as the case may be.

Figure 14:
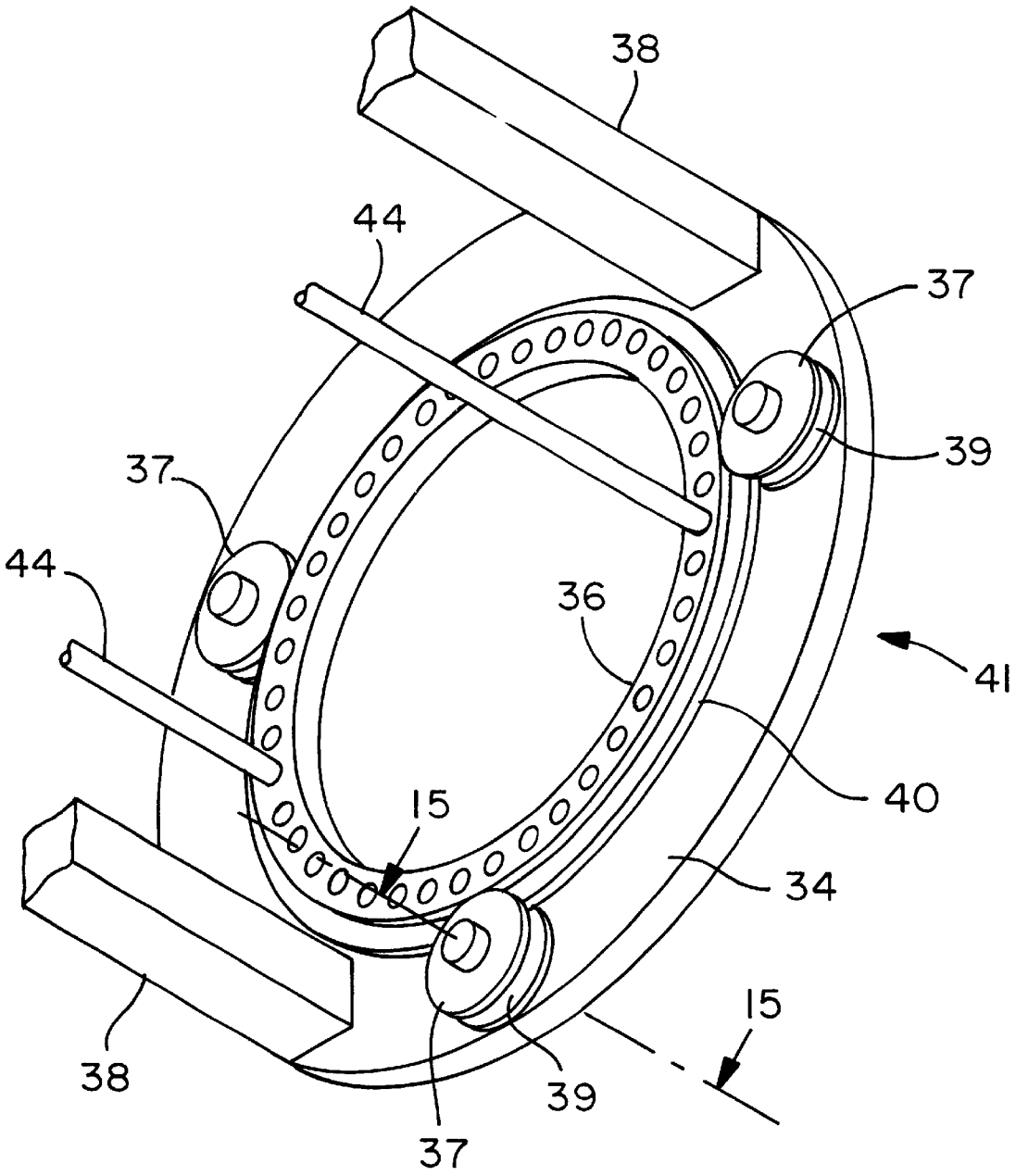
FIG. 14 is a perspective view of the rear outer and inner ring assembly.

Referring to FIGS. 6 and 7 the stem rod 52 applies pressure to the fixed pin 33 in the direction of arrow 63. By virtue of this pressure on the fixed pin restricted tissue in the wrist, forearm and/or elbow are stretched. Note that stretching of the tissue is brought about by the upper arm being retained in upper arm cuff 23 and the hand being retained in wrist stabilizer 18. Referring to FIG. 1 with both the hand and upper arm stabilized, pressure by the stem rod 52 on the fixed pin 33 attached to the front inner ring 32 will cause the inner ring to turn. Cradle rods 44 attached to the rear surface of the front inner ring 32 and rear inner ring 33 will turn (FIG. 14). Which in turn will cause wrist stabilizer 18 attached to front cradle 45 and rear cradle 46 to turn and cause stretch to the restricted tissue of the wrist, forearm or elbow as the case may be.

As illustrated in FIG. 8, once maximum stretch and comfort are achieved the loading knob is turned counter-clock wise. This releases the load on loading spring 78 and causes indicator screw to return to the low-number position. In FIG. 8 the stem rod 52 is shown also in dashed lines to show the position of full load and low load on stem rod 52. Further stretch may be required. For this additional stretch removable pin 35 is placed in green colored hole 67 for left hand. The removable pin 35 serves the same function as the fixed pin 33. The process as described in FIGS. 5, 6 and 7 is repeated with added load being brought about by turning the load screw 66, to put tension on chisel tip 80 at joint 55 to cause tension on the removable pin and thereby causing added stretching of restricted tissue.

As best shown in FIG. 6, there are around the circumference of the inner front ring 32 labeled and colored holes for receiving the removable pin during right hand or left hand; supination or pronation therapy. These holes have a bushing insuring a snug fit for the removable pin 35 and are identified as 63, 65, 67 and 69. Sixty-three (63) identifies red colored hole for the left hand; 65 identifies green colored hole for the right hand; 67 identifies green colored hole for the left hand and 69 identifies red colored hole for the right hand. The removable pin 35 in its proper hole determines the degree of stretch. In FIG. 6, arrow 59 indicates the direction in which the front end inner ring 32 and stem rod 52 move relative to the front outer ring 30.

With reference to FIG. 5 loading screw 66 is extended and indicator screw is in the zero (or low) position. This is shown by screw indicator marker 76 seen through port hole 56. With the screw indicator marker in the low position, the tension on loading spring 78 is least. As loading screw knob 68 is turned, loading screw 66 causes screw indicator marker 76 to be raised and at the same time more pressure is placed on stem rod 52 which abuts fixed pen 33. As the loading screw is turned, it forces the stem rod 52 against the fixed pin 33 causing the shortened connective tissue of the frozen wrist, forearm and/or elbow to stretch. The device is kept in this position as long as the patient can stand the stretch-tension. The pressure can be increased by turning the loading screw to maximum 9 as shown by the indicator screw 76 in port hole 56. Once this maximum pressure is maintained and the patient is comfortable with that degree of pressure, the loading screw knob can be turned to bring indicator marker to the zero area and the removable pin can be inserted in green hole 67, and the process repeated by increasing the pressure on the loading screw to thereby gain added stretch in connective tissue of the frozen wrist, forearm and/or elbow. By continuing to increase the pressure on the loading spring 78 by the use of the loading screw 66, maximum stretch of connective tissue is achieved and the mobility of the patients wrist, forearm and/or elbow can be restored.

FIGS. 9 to 13 and 16–21 are views of the housing tube assembly 50. The tension mechanism is contained in a housing tube 54. FIG. 9 illustrates a loading screw knob 68 and loading screw 66 which presses an indicator bar 72 and spring spacer 73. With reference to FIGS. 11 and 12, the load spring 78 fits over the spring spacer 73 onto bottom support 77 and chisel tip 80 fits inside and over the loading spring 78. In turn, the chisel tip 80 abuts the joint 55 of the stem rod and joint assembly which is housed in housing head 84. The joint and its surface are set to rotate about journal 82.

With special reference to FIG. 11, there is shown a sectional view of the tension mechanism contained in the tension housing tube 54, and housing head 84 with stem rod 52 attached to joint 55 which abuts chisel tip 80. Chisel tip 80 applies tension to the joint through loading spring 78 which in turn can have tension put on it through loading screw 66 and loading screw knob 68. As the loading screw knob 68 and loading screw 66 are tightened more and more pressure can be applied to the loading spring 78 which exerts more pressure on the stem rod 52 when the device is used. The amount of pressure is indicated by a screw indicator marker 76 (best shown in FIG. 9).

With reference to FIGS. 12 and 13, an exploded view of the tensioning assembly within the tension housing is made up of an indicator bar unit comprising two indicator bars 72 and a spring spacer 73, loading spring 78 and chisel tip unit 79 composed of a chisel tip 80 and boss 81. In operation the loading spring 78 is given tension by the loading screw 66 pressing against the bottom of spacer 77 and the chisel tip 80 pressing against the joint 55. The indicator bar 72 raises as the loading screw 66 presses on the bottom of spacer 77 of the indicator unit. The tension mechanism is similar to that shown in U.S. Pat. No. 5,558,624.

With special reference to FIG. 9, there is shown as part of the housing tube assembly 50 a viewing slot 56 showing indicator screw 76. In FIG. 9, the viewing slot 56 is projected enlarged to show the scale. The higher the number the higher the tension on the stem rod 52 and the greater the pressure on the wrist, forearm and elbow during therapy.

Figure 15:
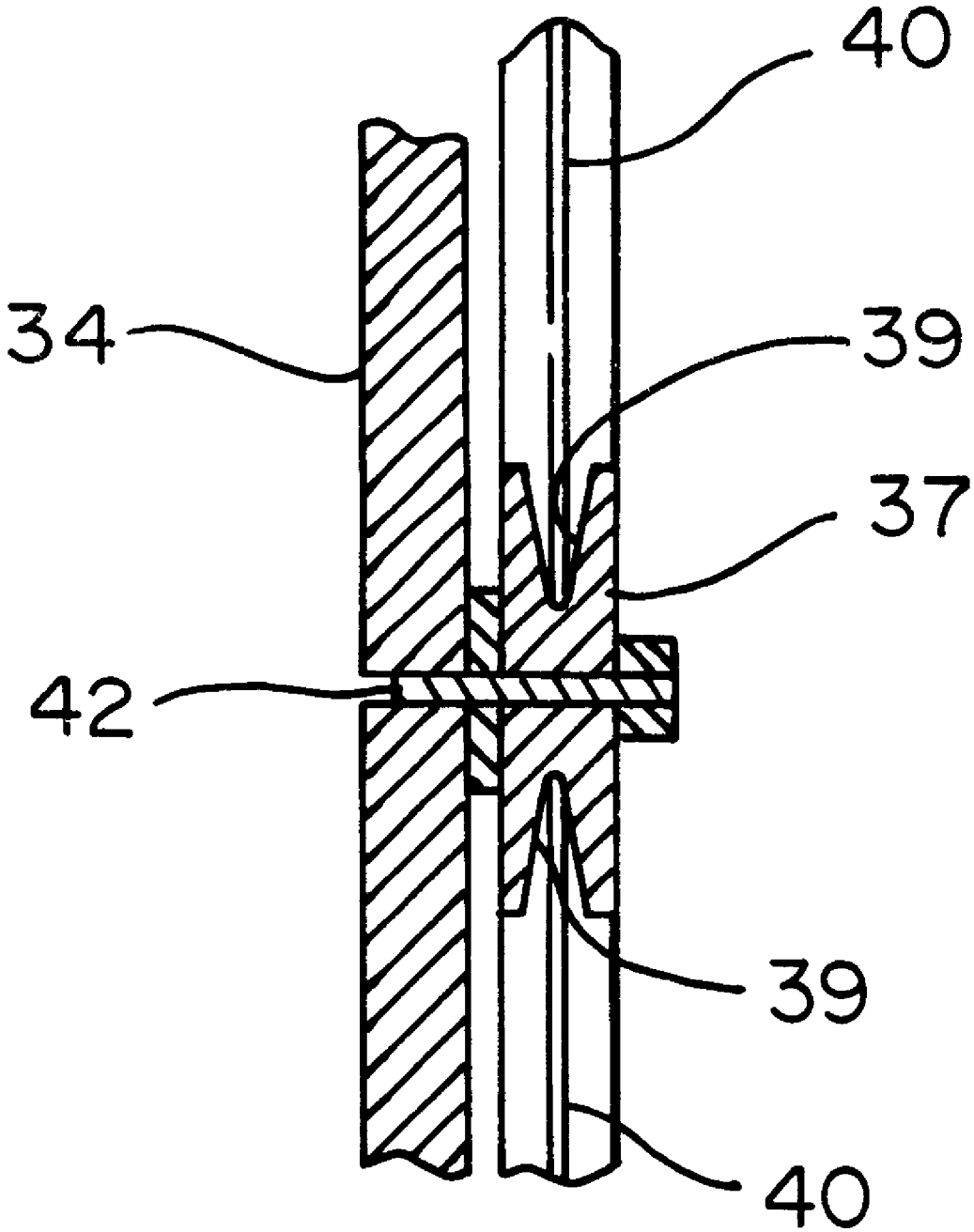
FIG. 15 is a cross-section of a V-flange wheel taken along 15—15 of FIG. 14.
Figure 16:
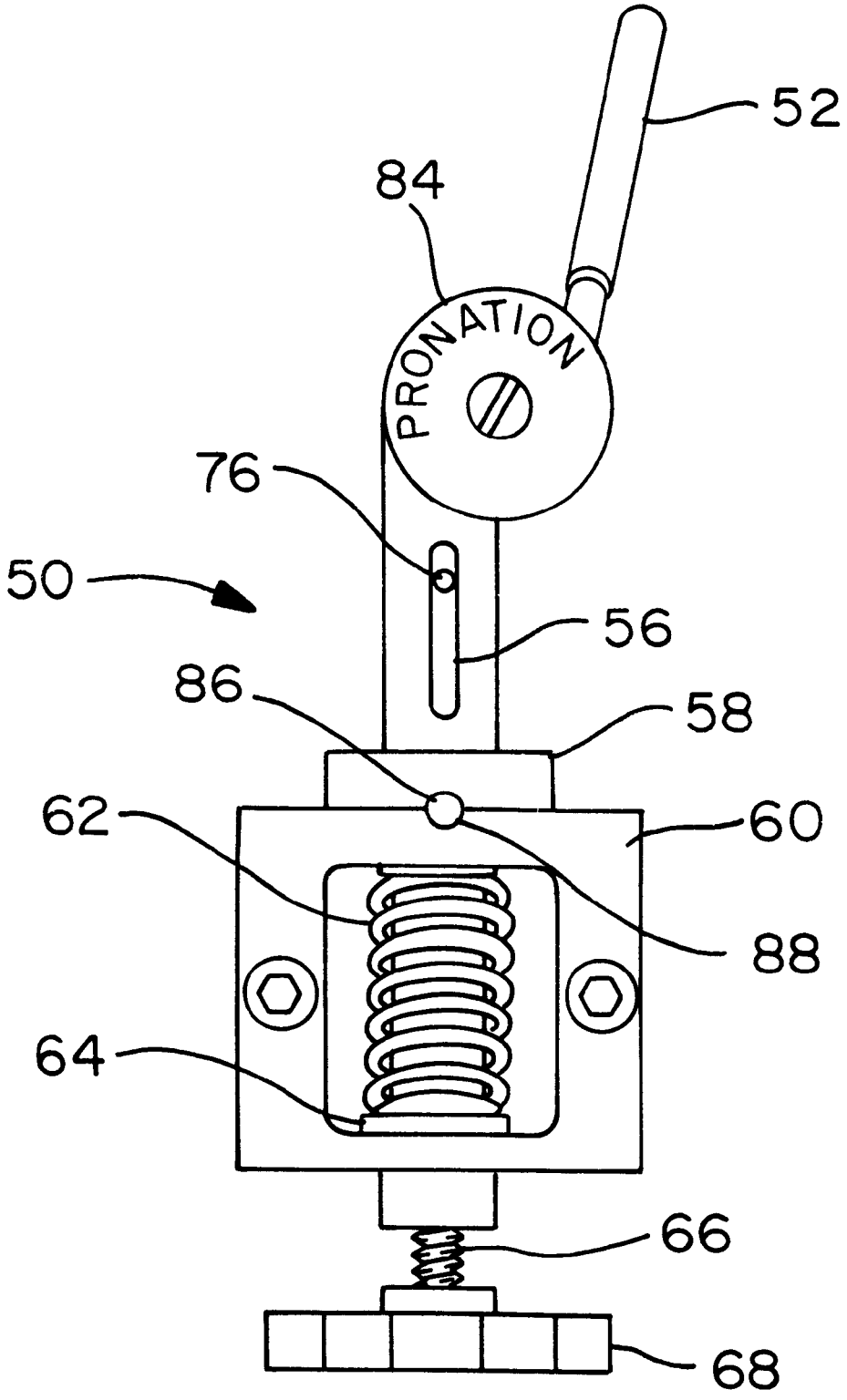
FIGS. 16–20 are views illustrating the mobile position of the housing tube bracket cradle.

Referring to FIGS. 14 and 15, the outer and inner ring sub-assembly is shown. In FIG. 14 a rear ring sub-assembly is shown, note however, the front ring sub-assembly is almost a mirror image of the rear ring sub-assembly. The major components of the rear ring sub-assembly 41 are a rear inner ring 36, a rear outer ring 34 and V-flange wheels 37. A cross sectional view of a V-flange wheel 37 is shown in FIG. 15. As shown, the V-flange wheel 37 has a V-shaped groove 39 in which rides the thin circumferential edge 40 of the inner ring 36. As shown in FIGS. 14 and 15, three V-flange wheels 37 are attached to the outer ring 34 through a fixed shaft 42 and the inner ring 34 rides on these three V-flange wheels 37. The V-flange wheels 37 are to be found in both the front and rear ring sub-assemblies. It is to be further pointed out that these wheels are ball bearing wheels.

As best shown in FIGS. 1–4, the front end outer ring 30 is attached to the rear end outer ring 34 through struts 38 and the front inner ring 32 is attached to the rear inner ring 36 through a pair of cradle rods 44 which are held in parallel through a front cradle 45 and a rear cradle 46 (shown in FIGS. 3 and 4). The wrist stabilizers for the right hand and left hand can be exchanged by unscrewing the wrist stabilizer from the cradles as best shown in FIG. 3.

Figure 20:
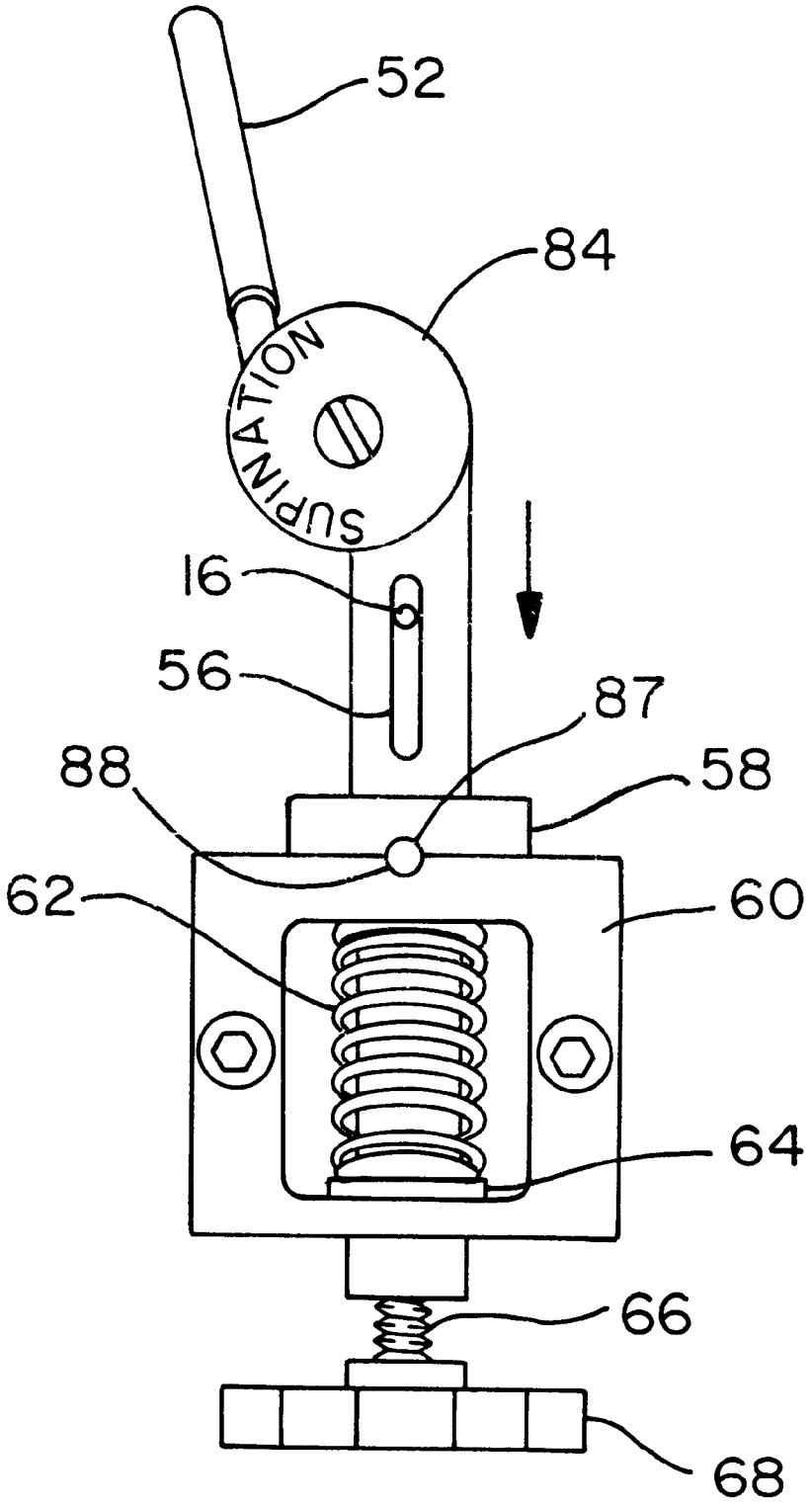

As best shown in FIGS. 16–20, an elegant feature of the supinator/pronator therapy device of this invention is the ability of the device to accommodate supination therapy or pronation therapy simply by swiveling the tension unit 50. If the unit is set for supination and pronation is desired, the tension unit can be swivelled 180° to accommodate pronation. The swiveling is accomplished by lifting the housing tube 54 which releases dowel pin detent 86 from its keeper 88 (FIG. 17); and then swiveling tension unit 50, (the arrows showing direction of swivel, FIG. 18) and releasing the tension unit so that dowel pin detent 87 returns to keeper 88 (FIGS. 19 and 20). In this way, the therapy device can be converted from the supination to the pronation therapy position. Note that locking spring 62 sits on collar 64. Locking spring 62 provides tension to keep dowel pins 86 and 87 in keeper 88. Note that fixed pin 33 is to be moved counter-clockwise to abut housing tube bracket 60 on the opposite side.

Note that stem rod 52 has a flat side 53 (shown in FIG. 18) which is intended to face the fixed pin 30 or movable pin 35 during therapy.

Figure 22:
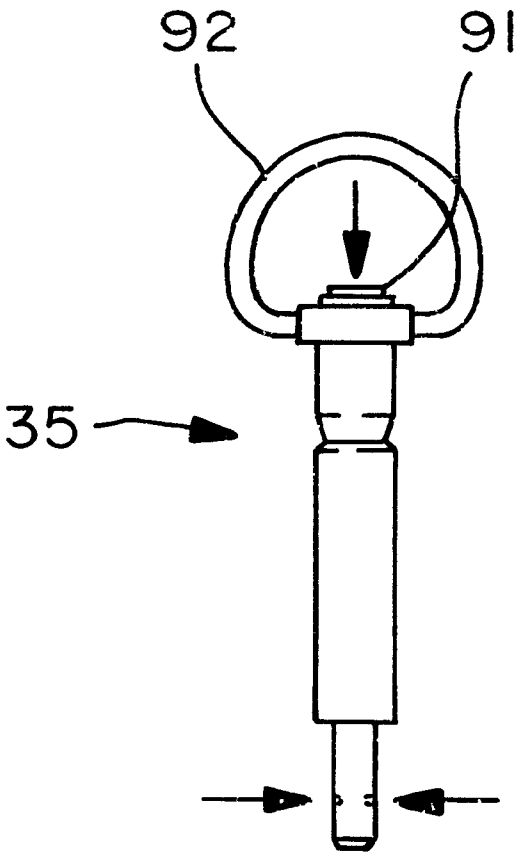
FIGS. 21 and 22 are views illustrating the removable pin.
Figure 21:
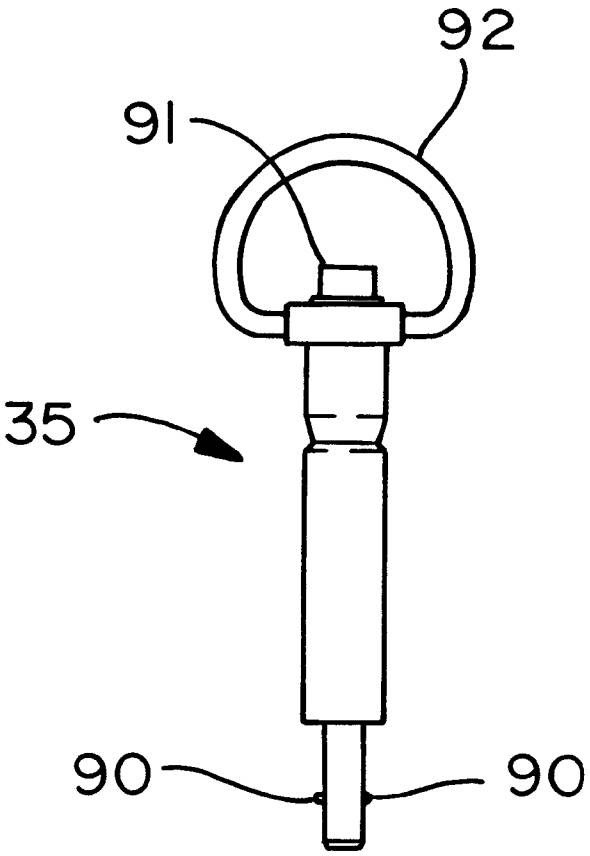

With reference to FIGS. 21 and 22, the quick-release removable pin 35 is shown. The removable pin 35 has yieldable detents 90 which are actuated for release by release button 91 being pushed down in the direction of the arrow and at the same time lifting on the D-ring 92.

The device as set forth herein is shown with circular cut-outs 93 (exemplified in FIGS. 2 and 5)these cut-outs are for lightening the weight of the device.

In its broadest aspect, the herein disclosed invention discloses a therapy device for passive use by a patient to bring mobility to the wrist, forearm and/or elbow, comprising a frame adapted to radially surround the patient's wrist and forearm, a subframe pivotably mounted within the frame for rotatable movement about a longitudinal axis substantially parallel to the patient's wrist and forearm, means for adjustably positioning the patient's wrist within the subframe for conjoint rotatable movement therewith, means for limiting the degree of rotatable movement of the subframe circumferentially with respect to the frame, and means for applying a retardation pressure in opposition to the rotatable movement of the subframe and thus causing the patient's wrist and elbow tissue to stretch and be returned to improved mobility. The device includes means for adjusting the degree of stretching force in opposition to the rotatable movement of the subframe; and further includes means for selecting alternate supination and pronation therapies. The device has means for limiting the degree of circumferential movement of the subframe within the frame, and means for applying an adjustable stretching force to the rotatable movement of the subframe, and includes an upper arm support pivotably mounted to the frame.

The frame of the therapy device of this invention comprises a pair of diametrically-opposite longitudinally-disposed tubular supports, a rod adjustably mounted within each of the tubular supports, longitudinally thereof, and a first pair of circular rings secured to the tubular supports, one at each end of the tubular supports. There is a bearing guide means between the respective first and second pair of circular rings enabling the rings to rotate parallel to each other. Note further that there is at least one transverse brace connected to the respective rods on the subframe.

The therapy device of this invention has the means for adjustably positioning the patient's wrist within the subframe comprises a wrist stabilizer adapted to be adjustably wrapped around the patient's wrist, and means for maintaining the wrist stabilizer in its adjusted position on the patient's wrist. Moreover, the wrist stabilizer can be changed to accommodate either the right or left hand.

The therapy device has a distal ring of the second pair of circular rings has a plurality of circumferentially spaced-apart holes formed therein, and wherein the mobile pin is received in one of the holes depending upon whether the patient's wrist is either the left wrist or the right wrist and, further, whether the therapy being applied to the patient's wrist is either supination or pronation. Moreover, there are four holes designated, two for supination and two for pronation, and wherein the holes are color coded. Defined another way, the therapy device can be described as one for passively stretching tissue at the wrist, elbow or forearm to gain mobility therein comprising a wrist and forearm retainer and an upper arm retainer, the hand and forearm retainer are fixedly retained between a set of inner and outer smaller grooved wheels; said sets of inner and outer smaller rings is retained by a set of grooved wheels affixed to a set of inner and outer larger rings, such that the set of inner and outer smaller rings are able to rotate freely in the set of grooved wheels and in a plane parallel to each set of inner and outer larger rings; the set of inner and outer larger rings has a spring and lever tension mechanism mounted thereon, such that with a pin mounted the inner smaller ring in juxtaposition with said lever of the spring and lever tension mechanism and when the wrist and forearm in the wrist and forearm retainer are turned by the pin with tension butting against the lever of the tension mechanism will cause the tissue of the wrist, elbow or forearm to stretch and gain normal mobility.

The Supinator/Pronator therapy device of this invention has been defined in terms of rotating rings, however, it is possible to produce the device with a rotating ring or arc containing the hand, wrist and forearm and the ring simply rotating in a race arrangement. Other modification apparent to those skilled in the art could be made without departing from the spirit of this invention.

Clinician and Patient Instructions for use of the Dynasplint™ Supinator/Pronator System The Dynasplint Supinator/Pronator System is designed to treat limited range-of-motion in the wrist and forearm caused by shortened connective tissues. This condition is most often the result of the elbow or wrist necessarily being immobilized for several days or weeks following an injury, illness or surgery. Frequently, elbow and wrist fractures, dislocation, burns and surgical repair of torn ligaments are the primary conditions requiring immobilization at the elbow or wrist. The ability to fully supinate or pronate the forearm can then be lost. In such cases the Dynasplint Supinator/Pronator System is a remarkably effective treatment. Just like Dynasplint's other systems the Dynasplint Supinator/Pronator System employs low-force applied to the restricted tissue for a prolonged period or several periods each 24-hour day. This treatment is commonly referred to as low-load, prolonged duration stretch (LLPS), and is the basis of treatment when using Dynasplint's Supinator/Pronator System which promotes permanent connective tissue elongation in a safe and time-efficient manner.

The optimal time to start treatment with the Dynasplint Supinator/Pronator System is 2–3 weeks after the immobilization period ends. For instance, if a patient suffered a Colles' or radial head fracture, the patient may need 3–6 weeks in a cast or some other type of immobilizer. When the immobilizer is removed, the patient should begin actively moving the wrist, forearm and elbow to restore the tissues to their normal length, which in turn allows full supination/pronation. Frequently, the range-of-motion still lacks sufficient progress despite more aggressive treatment using exercise and joint mobilization. If at the 2–3 week post-immobilization-period the patient's supination and/or pronation is significantly deficient, then LLPS treatment using the Dynasplint Supinator/Pronator System will greatly enhance the patient's return to full range-of-motion.

Just as in all other Dynasplin™ peripheral body joint devices, the supinator/pronator system employs in-line axis, spring adjustable technology for accurate, reproducible daily settings of time and intensity for consistent treatment day-to-day.

Depending on many factors, including patient history, diagnosis, compliance levels, degree and severity of condition being treated; the total time required from onset of treatment to completion of the program, using the Dynasplint Supinator/Pronator System, can range from three weeks to three months and occasionally longer.

THE FOLLOWING FITTING INSTRUCTIONS AND PROTOCOL ARE RECOMMENDED

Fitting Instructions With Reference to the Figures Set Forth Herein:

For Supination Motion of 45° or Less

1. With the mobile or removable pin 35 removed and the Dynasplint™ housing head 84 reading "Supination" when looking from the hand-cuff 18 to the housing head 84 centered just outside the distal-most ring, slip the patient's arm into the system so that the thumb is seated all the way through in the hand-cuff. Secure with Velcro™ fasteners around the hand-cuff and upper arm.cuff 23.

2. Adjust the forearm length by loosening the telescoping strut set screws one turn and telescoping in or out to have the mechanical elbow hinge 25 line up with the anatomical elbow. Snug the set screws 29 found in the edge of the rear outer ring (FIG. 4) to prevent further telescoping. For Supination Motion Less Than 90° But Greater Than 45°

1. Follow above instruction with one alteration. Place the removable pin 35 in the green receiving hole labeled "R" if it is the patient's right forearm or "L" if it involves the patient's left forearm AND- make certain that the stem rod 52 extending from the Dynasplint™ housing head 84 has the flat side resting against the removable pin 35 (FIGS. 5–8).

Protocol

The guiding principle in all protocols using LLPS is to achieve the following:

1. First, and of utmost importance, is to have the wearing time extend to the longest cumulative possible each 24-hour day up to but not exceeding 12 hours per day in any one direction. This time period achieved will be referred to as the "optimal" application time. In other words, wearing time of 12 hours per day will produce better results clinically, but it may be impractical to wear the device that long. On the other hand, 30 minutes may not be long enough to achieve desired tissue elongation.

Around 6–8 hours while sleeping or daytime use may be "optimal".

2. Second, once the optimal time of wear is achieved, then, without sacrificing even one minute of the optimal time on any given day, it is desirable to have the applied force be such that after removal, the patient will experience some degree of post-removal discomfort in the form of transient stiffness or aching in the forearm. This will indicate tissue stress producing elongation, which leads to range-of-motion improvement. Discomfort or aching beyond one hour is excessive and the next scheduled wearing should be done with slightly less tension in the Dynasplint spring.

Specifically follow these steps:

a. For the first day, turn the black tension knob or loading screw knob 68 clockwise the number of revolutions required to have the stem rod 52 just begin to slightly push the pin to a position of rotation which just meets the end range position available to the patient, based on where their the patient's range of motion (ROM) restriction begins. For instance, if the patient's ROM is restricted to 60° supination (90° is desired), the beginning tension level will approximate "2" on the scale 76 (FIG. 9).

b. Wear the system for up to 4 hours the first day.

c. On the $2^{nd}$ day, extend the time to beyond 4 hours by wearing while sleeping or through multiple daytime applications.

d. After several days, the optimal wearing schedule will be achieved and the tension setting using knob 68 can be advanced very gradually day-to-day until a tension level is achieved which both allows the patient to wear the system for the entire optimal time period while at the same time, producing some degree of post-wear discomfort (not lasting longer than 1 hour).

e. If no post-wear discomfort is sensed, without sacrificing any time of wear (which time should be between 6–8 hours cumulative each day), advance the tension knob 68 each day by ½ turn of the knob.

The inventors have developed a DYNASPLINT SYSTEMS® Treatment Protocol and Schedule.

These are guidelines only. If any time the user experiences pain, remove the Dynasplint immediately. Inform your doctor or therapist.

The doctor or therapist in practice will provide the patient with a protocol data sheet for instruction and record keeping; as for example:

Tension to be initially set at _____.

Patient will wear the Dynasplint System for ___hours the first day.

Patient will increase the wear time by ___hours each usage until you reach ___hours per each usage.

If not more than one-hour post-wear discomfort occurs, after time of wear is maximized, the tension may be increased by _____.

Maximum tension setting of ___. When you reach this setting contact your doctor or therapist.

This basic protocol outline is to provide maximum benefit from the Dynasplint Supinator/Pronator Therapy System. Increasing tension faster does not insure that proper stretch will be applied.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A passive therapy device for use by a patient to bring mobility to the wrist, forearm and/or elbow, wherein selective alternate supination and pronation therapies may be applied to the patients wrist, comprising a frame adapted to surround the patient's wrist and at least a portion of the patient's forearm radially thereof; a subframe pivotably mounted within the frame for rotatable movement about a longitudinal axis substantially parallel to the patient's wrist, means for adjustably positioning the patient's wrist within the pivotably-mounted subframe, means for limiting the degree of circumferential movement of the subframe within the frame, and means for applying an adjustable force to the rotatable movement of the subframe and wherein the frame comprises a pair of diametrically-opposite longitudinally-disposed tubular struts, a strut adjustably mounted within each of the tubular struts, longitudinally thereof, and a first pair of circular rings secured to the tubular struts, one at each end of the tubular struts.

2. The passive therapy device of claim 1, wherein the subframe comprises a pair of diametrically-opposite longitudinally-disposed struts, and a second pair of circular rings, one at each end of the rods, and concentrically disposed radially-inwardly of the first pair of circular rings secured to the tubular struts.

3. The passive therapy device of claim 2, further including bearing guide means between the respective first and second pair of circular rings.

4. The passive therapy device of claim 3, further including at least one transverse brace connected to the respective struts on the subframe.

5. The passive therapy device of claim 4, wherein the means for adjustably positioning the patient's wrist within the subframe comprises a wrist stabilizer adapted to be adjustably wrapped around the patient's wrist, and means for maintaining the wrist stabilizer in its adjusted position on the patient's wrist.

6. The passive therapy device of claim 5, wherein the wrist stabilizer has an opening formed therein for receiving the patient's thumb.

7. The passive therapy device of claim 2, wherein the first pair of circular rings comprises a proximate ring and a distal ring, wherein the second pair of circular rings comprises a proximate ring and a distal ring, wherein each of the distal rings of the respective first and second pair of circular rings has a lower face, and wherein the means for applying an adjustable force to the rotatable movement of the subframe comprises a housing mounted on the lower face of the distal ring of the first pair of rings, the housing including a cylindrical position projecting radially inwardly of the distal ring of the first pair of rings, a member journaled within the cylindrical portion of the housing, means for limiting the degree of rotary movement of the member within the cylindrical portion of the housing, a compression spring between the member and the cylindrical portion of the housing, manually-manipulatable means on the housing for adjusting the force of the compression spring, the member having a radial extension, a mobile pin selectively mounted on the circumference of the distal ring of the second pair of circular rings of the rotable subframe, the mobile pin being adapted to engage the radial extension of the member, a stationary pin on the distal ring of the second pair of circular rings, and a stop on the distal ring of the first pair of circular rings on the frame, thereby circumferentially limiting the degree of rotable movement of the subframe said adjustable force causing through passive force stretching of restricted tissue of the wrist, forearm or elbow for their return to improved mobility.

8. The passive therapy device of claim 7, wherein the distal ring of the second pair of circular rings has a plurality of circumferentially spaced-apart holes formed therein, and wherein the movable pin is received in one of the holes depending upon whether the patient's wrist is either the left wrist or the right wrist and, further, whether the therapy being applied to the patient's wrist is either supination or pronation.

9. The passive therapy device of claim 8, wherein four of the holes are designated, two for supination and two for pronation, and wherein the holes are color coded.

10. The passive therapy device of claim 8, further including means for removably locking the mobile pin in a selected hole, comprising a spring-loaded detent on the mobile pin, the detent being adapted to engage an upper face on the distal ring of the second pair of circular rings on the rotatable subframe, and a central shaft slidably mounted within the pin for releasing the detent, the central shaft having a release button externally of the mobile pin.

11. The passive therapy device of claim 10, further including a ring carried by the mobile pin and disposed radially of the release button.

12. A passive therapy device for stretching tissue at the wrist, forearm or elbow to gain mobility therein comprising a wrist stabilizer and an upper arm cuff, the wrist stabilizer is fixedly retained between sets of inner and outer smaller rings;

said sets of inner and outer smaller rings are retained by a race affixed to a set of inner and outer larger rings, such that the set of inner and outer smaller rings is able to rotate freely in the race and in a plane parallel to each set of inner and outer larger rings;

a set of struts joins the set of inner rings and a set of struts joins the outer rings;

the front smaller ring has a fixed pin and the front outer larger ring has a spring and lever tension mechanism mounted thereon;

such that with the fixed pin, mounted on the inner smaller ring, in juxtaposition with said lever of the spring and lever tension mechanism and with the wrist in the wrist stabilizer and the upper arm in the cuff, tension of the pin in juxtaposition with the lever of the tension mechanism will cause the tissue of the wrist, forearm and/or elbow to stretch and gain normal mobility.

13. The passive therapy device of claim 12 wherein the race is a set of grooved wheels.

14. A passive therapy method for stretching restricted tissue of the wrist, forearm and/or elbow to gain normal flexibility comprising inserting the wrist, forearm and upper arm in the device of claim 12 and stretching the restricted tissue of the wrist, forearm or elbow to gain mobility.

* * * * *